US005675111A

United States Patent [19]

Goudour et al.

[11] Patent Number: 5,675,111

[45] Date of Patent: Oct. 7, 1997

[54] TRANSMISSION ASSEMBLY WITH A TELESCOPIC UNIVERSAL JOINT, WEAPON HAVING SUCH A TRANSMISSION ASSEMBLY AND METHOD

[75] Inventors: Alain Goudour, Naves; Christian Gyre, Chameyrat, both of France

[73] Assignee: Giat Industries, Versailles Cedex, France

[21] Appl. No.: 489,165

[22] Filed: Jun. 9, 1995

[30] Foreign Application Priority Data

Jun. 16, 1994 [FR] France ..... 94 07357

[51] Int. Cl.[6] ..... F41A 9/30

[52] U.S. Cl. ..... 89/33.16; 89/33.17

[58] Field of Search ..... 89/33.16, 33.17, 89/33.25, 42.01, 42.03

[56] References Cited

U.S. PATENT DOCUMENTS

| | | | |
|---|---|---|---|
| 2,390,477 | 12/1945 | Trotter | 89/33.16 |
| 2,469,333 | 5/1949 | Farrell et al. | 89/42.01 |
| 2,773,425 | 12/1956 | Weeks . | |
| 3,296,930 | 1/1967 | Rocha | 89/33.25 |
| 4,052,927 | 10/1977 | Flatan | 89/1.51 |
| 4,612,843 | 9/1986 | Marcon et al. | 89/33.25 |

FOREIGN PATENT DOCUMENTS

| | | | |
|---|---|---|---|
| 0 306 061 | 3/1989 | European Pat. Off. . | |
| 2 547 042 | 12/1984 | France | 89/33.05 |
| 6709126 | 1/1968 | Netherlands | 89/33.25 |

*Primary Examiner*—Stephen M. Johnson
*Attorney, Agent, or Firm*—Oliff & Berridge

[57] ABSTRACT

A transmission assembly for transmitting power between a fixed part and a moving part of a weapon, the moving part being disposed to move in response to recoil of the weapon, includes a drive motor, a mechanism, and a transmission device. The drive motor is attached to the fixed part. The mechanism is attached to the moving part. The transmission device is coupled to the drive motor and to the mechanism. The transmission device transmits power from the drive motor to drive the mechanism and includes a telescopic universal joint assembly. As a result, the transmission assembly permits power to be reliably supplied from the drive motor to the mechanism.

19 Claims, 2 Drawing Sheets

TRANSMISSION ASSEMBLY WITH A TELESCOPIC UNIVERSAL JOINT, WEAPON HAVING SUCH A TRANSMISSION ASSEMBLY AND METHOD

BACKGROUND OF THE INVENTION

The subject of the present invention is that of a transmission assembly designed for an automatic weapon that includes a fixed part and a mobile part subjected to a recoil movement when the weapon is fired, the assembly having a driving motor arranged on the fixed part, a mechanism driven by the motor, which is integral with the mobile part, and a transmission device ensuring the transmission of power between the driving motor and the mechanism driven by the said motor. A transmission assembly of this type is known for weapons having a short recoil stroke of approximately 20 mm. The transmission device includes a set of gear wheels that slide over one another and enabling the recoil and counter-recoil stroke to be eliminated.

This relatively simple solution is not applicable to weapons having a longer recoil stroke because of problems of elasticity, of proportion and geometric positioning of parts of weapons with longer recoil that can only be overcome at great additional expense.

SUMMARY OF THE INVENTION

An object of the present invention is a transmission assembly of the afore-mentioned type, having a transmission device that can be applied to weapons having a large recoil stroke and that is easy to manufacture.

The transmission assembly according to the invention includes a transmission device having a telescopic universal joint.

The mechanism driven by the motor is a kinematic firing assembly of the weapon.

According to a particularly advantageous embodiment, the telescopic universal joint is homokinetic. In other words, the speeds at which an input end and an output end of the telescopic universal joint rotate are the same. The telescopic joint may thus include:

- a first universal joint driven in rotation on its up side by the motor,
- a driving element driven in rotation by the down side of the first universal joint,
- a driven element integral in rotation with the driving element, but being able to move translationally with respect to the driving element, and
- a second universal joint driven in rotation on its up side by the driven element, and driving in turn, by its down side, the mechanism.

The mechanism may include an input element driven by the universal joint, for example by the second universal joint, the input element having a rotational axis which is approximately the same as that of the motor. In this event, the universal joint is in an extended position and is thus subject to lower strains induced by its being driven into rotation by the motor.

The input element may be a motor gear integral in rotation with the second universal joint, on the down side, and meshing with a gear of the weapon driving the said mechanism.

It is advantageous that the driving element be a spline shaft and the driven element be a spline sleeve, or that the driving element be a spline sleeve and the driven element be a spline shaft.

A further object of the invention is an implementation process of a transmission assembly such as that described above, including the steps of activating the driving motor to drive the mechanism constantly during a firing sequence in such a manner that the telescopic universal joint absorbs the recoil and possibly even the counter-recoil of the mobile part while ensuring the uninterrupted transmission between the motor and the mechanism.

BRIEF DESCRIPTION OF THE DRAWINGS

The invention will become clearer after reading the description which follows, given by way of illustration, non-exhaustively, in reference to the appended drawings in which.

DETAILED DESCRIPTION OF PREFERRED EMBODIMENTS

Figure 1A:
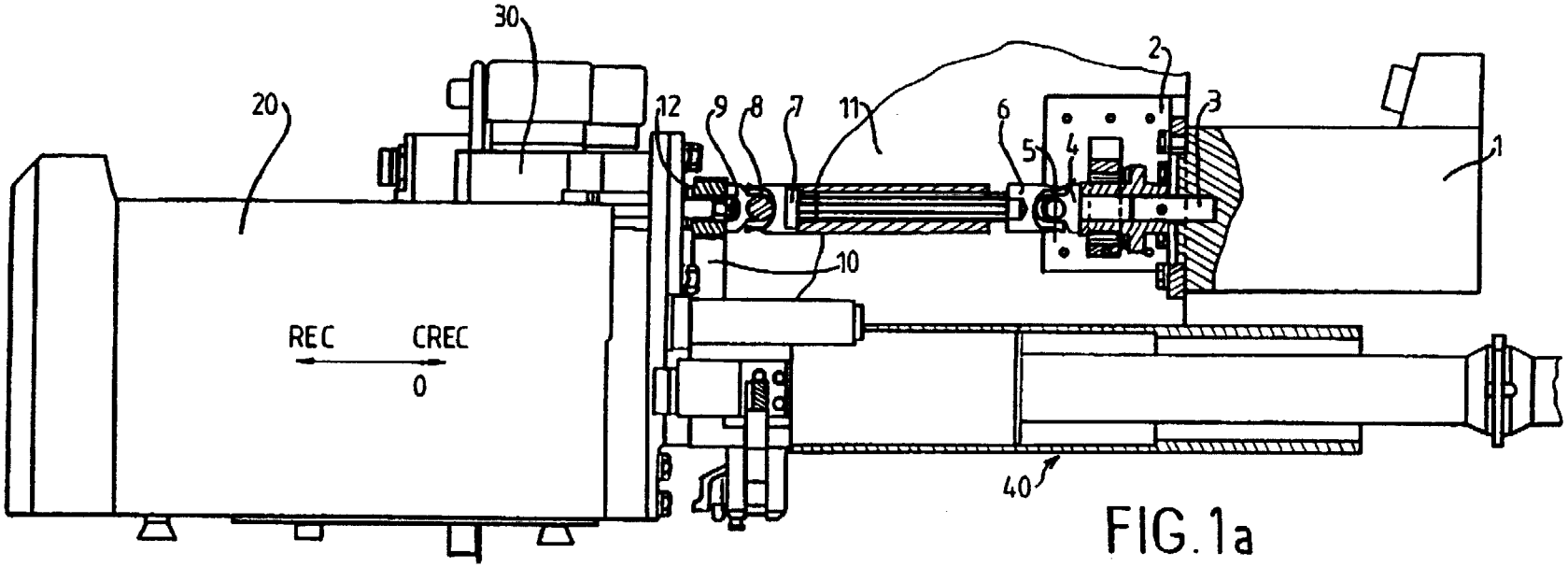
FIG. 1*a* shows a side view of a weapon fitted with a transmission assembly according to the invention shown in a partial cross-section.
Figure 2A:
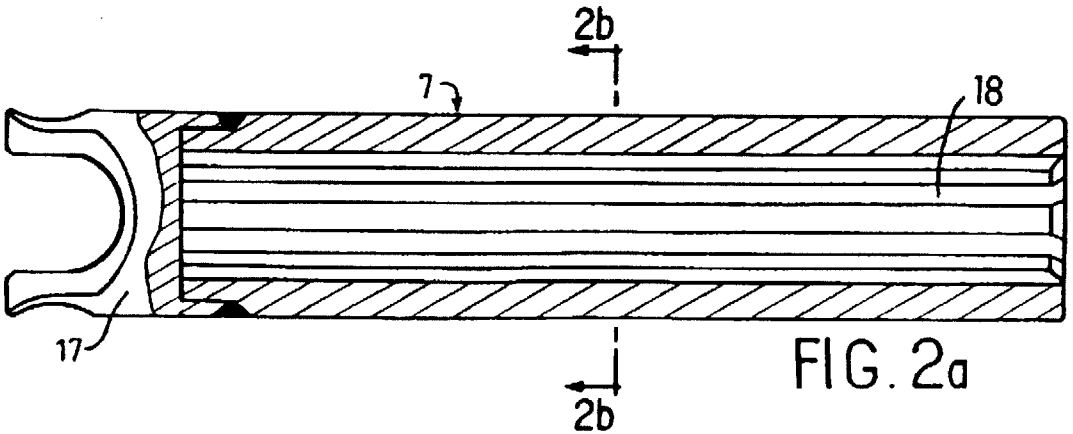
FIG. 2*a* shows front cross section of a spline sleeve according to a preferred embodiment of the invention.
Figure 2B:
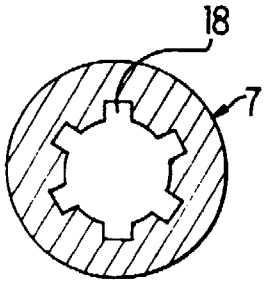
FIG. 2*b* shows a side cross section of the spline sleeve taken along line 2*b*—2*b* of FIG. 2*a;*
Figure 1B:
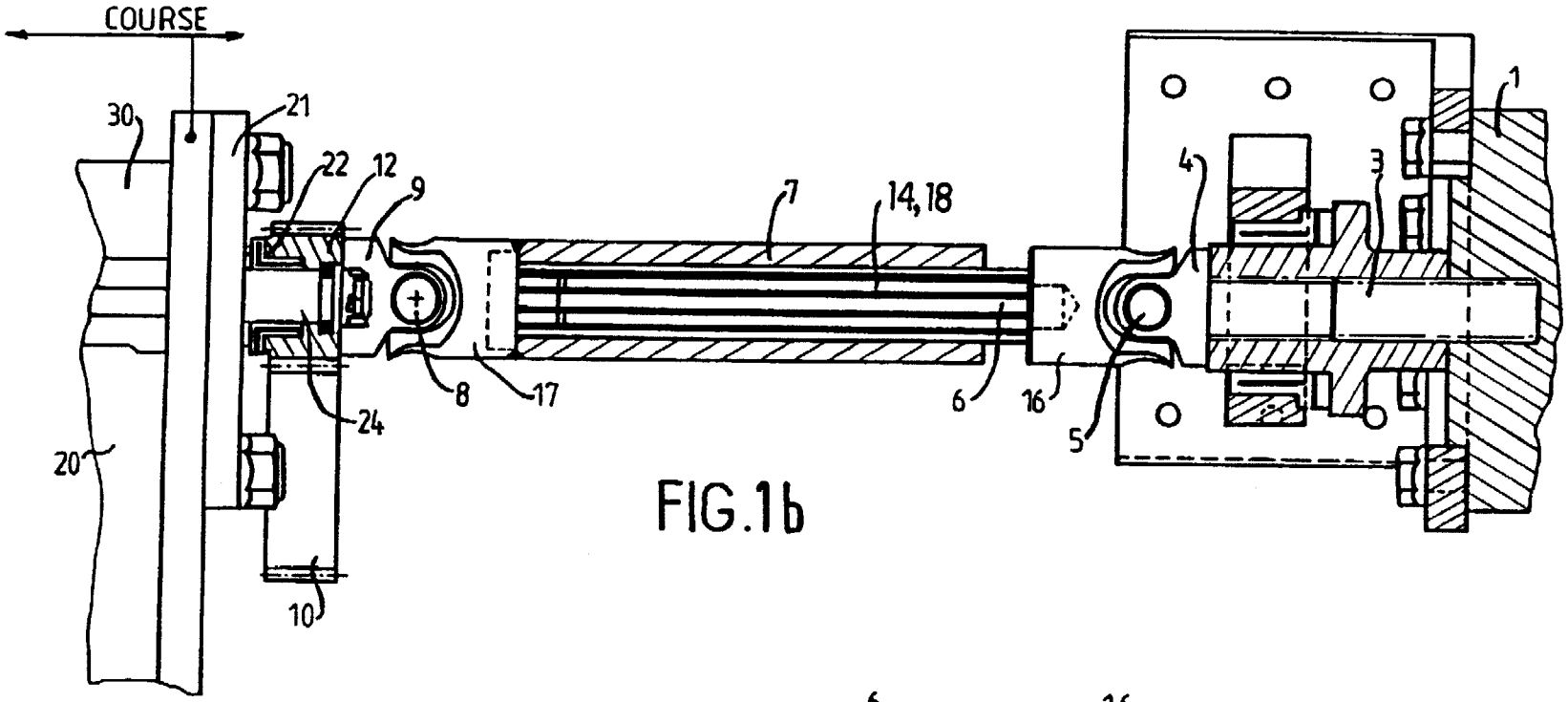
FIG. 1*b* is an an enlarged detail of FIG. 1*a;*
Figure 3B:
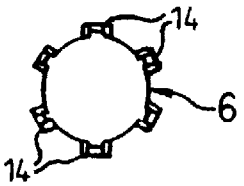
FIG. 3*b* shows a left view of FIG. 3*a* with the part 16 removed.
Figure 3A:
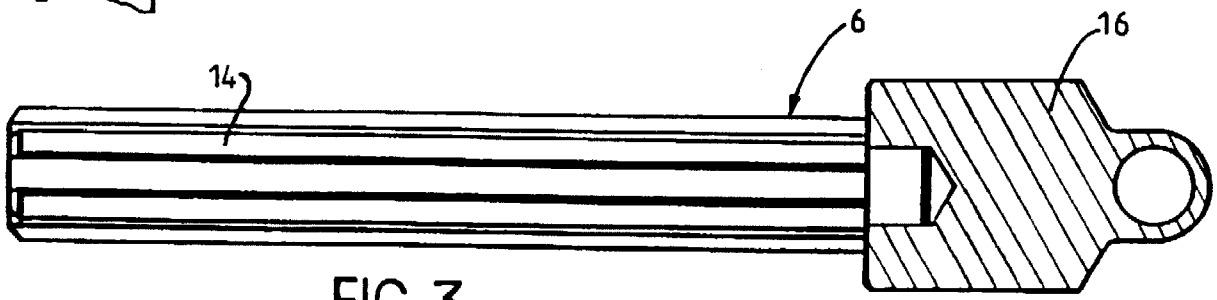
FIG. 3*a* shows a spline shaft cooperating with the sleeve shown in FIG. 2*a* and 2*b*.

FIGS. 1*a* and 1*b* show a small or medium caliber weapon having an external source of power, for example a machine gun, which has a motor 1 mounted on a fixed part of the weapon, in this case a weapon rest 11, by a plate 2.

The weapon also includes a recoiling mass 20 mechanically linked to the cannon 40 of the weapon. A mechanism 30, particularly designed to ensure control of the weapon kinematics, i.e., the munition supply and the firing of the weapon, is mounted on the recoiling mass 20.

Transmission between the motor 1 and the mechanism 30 is ensured by a universal joint which in the preferred embodiment shown has a first universal joint 5 driven by a part 4 integral with the driving shaft 3 of the motor 1, a spline shaft 6 having male splines 14 and which is driven by a part 16 located on the down side of the universal joint 5, a spline sleeve 7 having female splines 18 cooperating with the male splines 14 to ensure a drive which is integral in rotation with the shaft 6 and the sleeve 7, and a second universal joint 8 driven by its up side by a part 17 integral with the spline sleeve 7 and driving in turn by its down side a part 9 fitted with a drive gear 12 which transmits the movement to the kinematics 30 of the weapon via driven gear 10.

The connection established by the telescopic universal joint between the weapon, which is mobile in translation and has a recoil stroke and a counter-recoil stroke, and its motor 1 fixed on the weapon rest 11, enables the retransmission of a continuous rotational movement irrespective of the relative position of the weapon on its rest. The fact of positioning the motor 1 on a fixed part 11 and not on the weapon itself enables costs to be reduced given that the motor 1 is subjected to less mechanical stress.

Furthermore, because the rotational axis of the drive shaft is, to within the tolerance of the alignment, the same as that of the shaft 24 of the drive gear 12 no bevel gear for the universal joint is required, and therefore the shaft is subjected to minimum strain for the transmission of the rotational movement.

Moreover, the transmission device does not require the precise positioning of the motor 1 with respect to the weapon 20, because the possible misalignment of the axis 3 of the motor 1 and of the drive gear 12 is accommodated by the universal joint without subjecting the universal joint to any significant mechanical strains.

By way of example, a transmission device such as described above has been implemented in a 30 mm calibre machine gun operating at a rate of 500 rounds/second and having a recoil/counter-recoil stroke of approximately 80 mm, the recoiling mass 20 being subject to maximum acceleration of 600 g and the mechanism 30 being driven by a motor 1 having a rotation velocity of 2000 rpm. The transmission device for the movement described above enables the mechanical strains to be minimized despite the long recoil stroke and the high rate of fire while ensuring the uninterrupted transmission of a substantial rotational torque at a high rotational velocity.

We claim:

1. A transmission assembly that transmits power between a fixed part and a moving part of a weapon, said movable part being disposed to move in response to recoil of said weapon, said transmission assembly, comprising:

a drive motor attached to said fixed part;

a mechanism attached to said moving part; and a transmission device coupled to said drive motor and to said mechanism that transmits power from said drive motor to drive said mechanism, wherein said transmission device includes a telescopic universal joint assembly.

2. The transmission assembly of claim 1, wherein said mechanism includes an input element coupled to and driven by said telescopic universal joint assembly, said input element having an input element rotational axis and said drive motor having a drive motor rotational axis, and wherein said input element rotational axis and said drive motor rotational axis are approximately collinear.

3. The transmission assembly of claim 1, wherein said mechanism includes a recoiling mass attached to and disposed to move with said mechanism.

4. The transmission assembly of claim 1, wherein said telescopic universal joint assembly includes a first universal joint coupled to and driven by said drive motor, a driving element connected to and driven by said first universal joint, a driven element disposed to slide in translation along said driving element, and a second universal joint connected to and driven by said driven element, said second universal joint being coupled to and disposed to drive said mechanism.

5. The transmission assembly of claim 4, wherein said mechanism includes an input element coupled to and driven by said second universal joint, said input element having an input element rotational axis and said drive motor having a drive motor rotational axis, and wherein said input element rotational axis and said drive motor rotational axis are approximately collinear.

6. The transmission assembly of claim 5, wherein said input element includes a drive gear and said mechanism includes a driven gear, and wherein said drive gear is disposed to rotate with said second universal joint and to engage said driven gear to drive said mechanism.

7. The transmission assembly of claim 6, wherein said driving element is one of a splined sleeve and a splined shaft, said splined shaft being shaped to rotate with and slide within said splined sleeve, and wherein said driven element is the other of said splined sleeve and said splined shaft.

8. The transmission assembly of claim 6, wherein said drive gear has a drive gear rotational axis and said driven gear has a driven gear rotational axis whereby the drive gear rotational axis is disposed approximately parallel with and spaced apart from said driven gear rotational axis.

9. The transmission assembly of claim 4, wherein said driving element is one of a splined sleeve and a splined shaft, said splined shaft being shaped to rotate with and slide within said splined sleeve, and wherein said driven element is the other of said splined sleeve and said splined shaft.

10. The transmission assembly of claim 1, wherein said fixed part includes a weapon rest.

11. The transmission assembly of claim 1, wherein said telescopic universal Joint is homokinetic.

12. A method of transmitting power between a fixed part and a moving part of a weapon during a firing sequence using a transmission assembly having a drive motor attached to said fixed part, a mechanism attached to said moving part and a transmission device having a telescopic universal joint coupled to said drive motor and to said mechanism, said method comprising:

driving said mechanism with said drive motor through said transmission device at an approximately constant rate; and adjusting a length of said telescopic universal joint assembly.

13. The method of claim 12, wherein said step of adjusting includes adjusting said length in accordance with a recoil stroke length of said weapon.

14. The method of claim 12, wherein said step of adjusting includes adjusting in accordance with a counter-recoil stroke length of said weapon.

15. The method of claim 12, wherein said step of adjusting includes sliding a splined shaft within a splined sleeve shaped to receive and to rotate with said splined shaft.

16. The method of claim 12, wherein said step of driving includes driving a drive gear coupled to said mechanism with said telescopic universal joint assembly.

17. A weapon having a fixed part, a movable part that moves in response to recoil of said weapon and a transmission assembly coupled to said fixed part and to said movable part, said transmission assembly comprising:

a drive motor attached to said fixed part;

a mechanism attached to said moving part; and a transmission device coupled to said drive motor and to said mechanism that transmits power from said drive motor to drive said mechanism, wherein said transmission device includes a telescopic universal joint assembly.

18. The weapon of claim 17, wherein said telescopic universal joint assembly includes a first universal joint coupled to and driven by said drive motor, a driving element connected to and driven by said first universal joint, a driven element disposed to slide in translation along said driving element, and a second universal joint connected to and driven by said driven element, said second universal joint being coupled to and disposed to drive said mechanism.

19. The weapon of claim 18, wherein said driving element is one of a splined sleeve and a splined shaft, said splined shaft being shaped to rotate with and slide within said splined sleeve, and wherein said driven element is the other of said splined sleeve and said splined shaft.

* * * * *